United States Patent [19]

Brown

[11] 4,439,650

[45] Mar. 27, 1984

[54] SWITCH ASSEMBLY FOR AUTOMOTIVE PEDAL CONSTRUCTION

[75] Inventor: William L. Brown, Southfield, Mich.

[73] Assignee: John D. Leighton, Bloomfield Hills, Mich.

[21] Appl. No.: 311,191

[22] Filed: Oct. 14, 1981

[51] Int. Cl.[3] ..... H01H 3/14

[52] U.S. Cl. ..... 200/61.89; 200/86.5; 200/303

[58] Field of Search ..... 200/61.89, 61.86, 61.85, 200/86.5, 61.87, 61.9, 153 C, 294, 295, 86, 303; 340/71

[56] References Cited

U.S. PATENT DOCUMENTS 2,674,669 4/1954 Leedam ..... 200/86.5

FOREIGN PATENT DOCUMENTS 2724051 12/1978 Fed. Rep. of Germany ..... 200/86.5

*Primary Examiner*—E. A. Goldberg
*Assistant Examiner*—Morris Ginsburg
*Attorney, Agent, or Firm*—Harness, Dickey & Pierce

[57] ABSTRACT

An improved brake light switch that is integrated into the brake pedal and actuated by the application of pressure to the pedal. The pedal pad is movable relative to the pedal and this relative movement effects closure of the switch.

8 Claims, 7 Drawing Figures

SWITCH ASSEMBLY FOR AUTOMOTIVE PEDAL CONSTRUCTION

BACKGROUND OF THE INVENTION

This invention relates to a switch assembly for an automotive pedal construction and more particularly to an improved and compact switch that is mounted within the pad of the associated pedal assembly.

In the co-pending application of John D. Leighton, entitled "Pedal Operated Assembly" filed July 29, 1981 Ser. No. 287,882, now U.S. Pat. No. 4,404,439 issued Sept. 13, 1983, to whom this patent is assigned, the advantages of providing a switch and vacuum interrupting assembly directly in a brake pedal are described. Generally, such an arrangement has the advantages of simplifying installation, offering a compact integrated package by the motor vehicle manufacturer, reduces warranty costs, and offers an eariler brake operation warning than with conventional arrangements. In accordance with that invention, the pedal pad carries the switch assembly and is supported for relative movement by the brake pedal. This limited relative movement is taken up when the pedal is depressed and is utilized for actuating the switch and vacuum interrupting device. This invention is directed toward an improved switch and vacuum interrupting device for such an arrangement.

SUMMARY OF THE INVENTION

This invention is adapted to be embodied in a signal mechanisn for a pedal operated device that includes an actuating element for the device and a pedal pad detachably connected to the actuating element. First and second flexible electrical contacts are supported by the pedal pad for movement relative to each other. Means are associated with one of these contacts and is engageable with the actuating element for moving the contacts into engagement with each other to complete an electrical circuit when the pedal pad is actuated.

DETAILED DESCRIPTION OF THE PREFERRED EMBODIMENT

Figure 1:
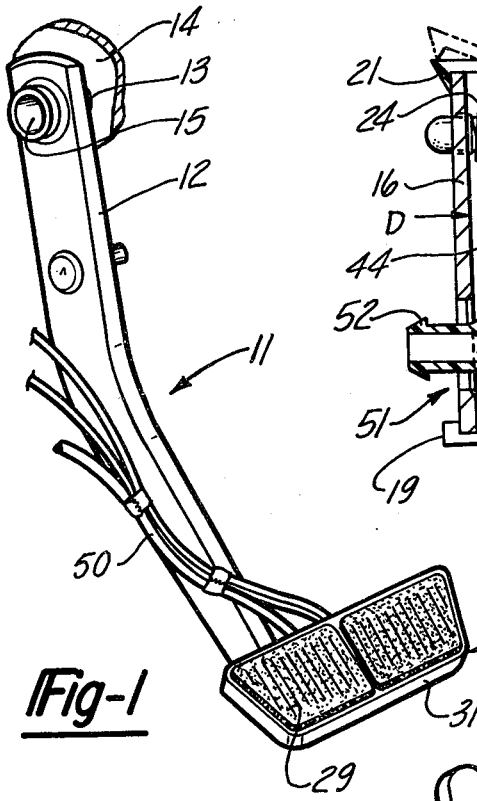
FIG. 1 is a perspective view of an automotive brake pedal assembly embodying this invention.

An embodiment of an automotive brake pedal assembly embodying this invention is shown in FIGS. 1–7 and is identified generally by the reference numeral 11. The brake pedal and associated linkage is employed to actuate an automotive braking system in a known manner. Associated with the conventional brake pedal is a remotely positioned brake light switch. In addition, operation of the brake pedal may be employed to operate a further switch for deactivating a lock up clutch in certain types of automatic transmissions, as well as a further switch for disengaging the speed control unit of the associated vehicle. Furthermore, it has recently been proposed to employ this movement of the brake pedal as a device for opening an atmospheric bleed in the vacuum circuit of a servo motor of the speed control device so as to provide an additional safety factor in the event the electrical system of the speed control unit is not disabled. Previously, it has been proposed to use one or more switches and valves that are operated remotely from the linkage system of the brake unit so as to achieve these results. In addition to being installed on the assembly line, such prior art arrangements required adjustment on installation and frequently readjustment during use. This invention is directed toward an improved system wherein all of these functions can be provided directly at the brake pedal; thus reducing cost on assembly, reducing warranty costs and eliminating the possibility of human error on installation and adjustment. Furthermore, with certain of the prior art devices improper adjustment would prevent complete release of the brake resulting in unnecessary brake wear and poor fuel economy.

The brake pedal assembly 11 includes a lever 12 that is integrally connected with a bushing 13 that is pivotally supported on the fire wall 14 of the vehicle in a known manner, as by means of a pivot pin 15. A brake pedal plate 16 is affixed in any known manner, as by welding, to the lower end of the brake pedal lever 12. A combined pedal pad and signal device, indicated generally by the reference numeral 17, is detachably connected to the brake pedal plate 16 in a manner to be described.

Figure 4:
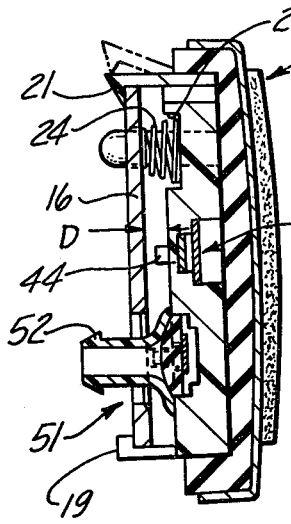
FIG. 4 is a cross-sectional view taken alone the line 4—4 of FIG. 3.
Figure 5:
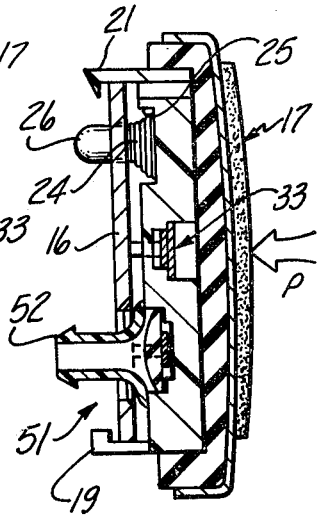
FIG. 5 is a cross-sectional view, in part similar to FIG. 4, showing the mechanism at it appears when pressure is applied to the pedal pad by the foot of an operator.
Figure 2:
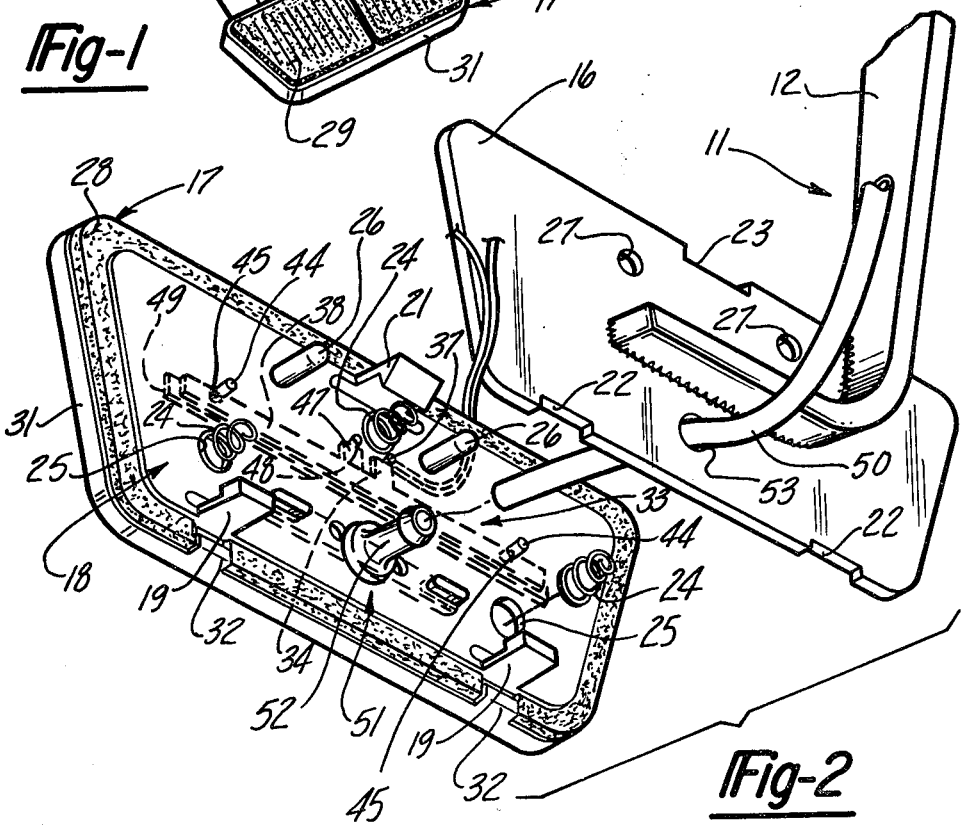
FIG. 2 is an enlarged, exploded view of the pedal mechanism looking in the opposite direction from FIG. 1.
Figure 3:
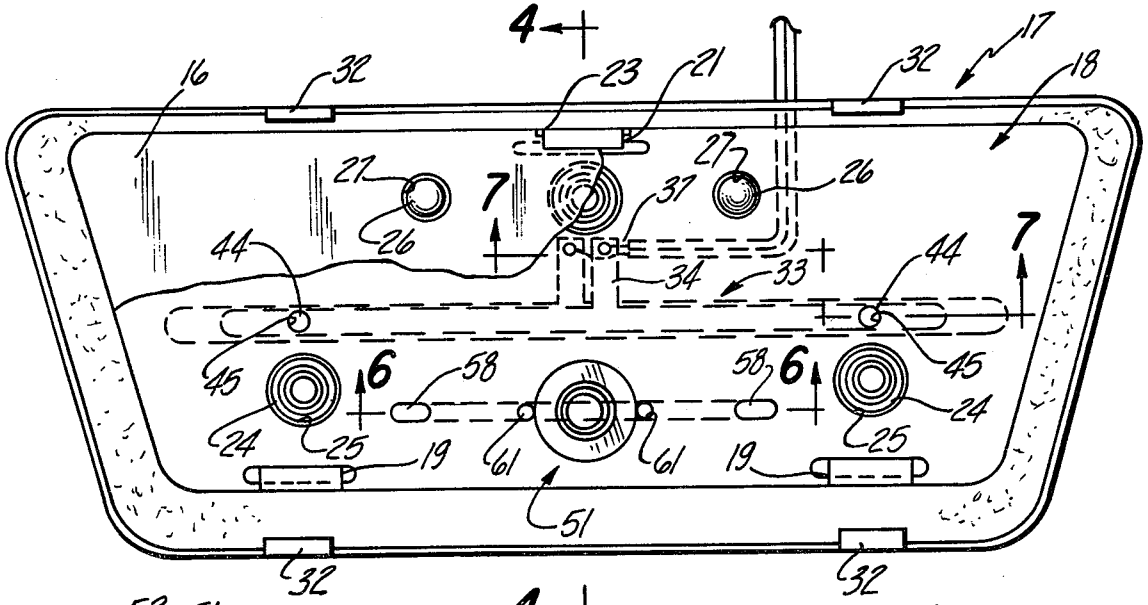
FIG. 3 is an enlarged plan view of the pedal mechanism.

The pedal pad 17 is a multi-part assembly that is adapted to be detachably connected as a unit to the brake pedal plate 16. The pad assembly 17 includes a substantially rigid backing piece, indicated generally by the reference numeral 18, that is formed with a pair of integrally lower tabs 19 and a single, integral upper tab 21. The tabs 19 and 21 cooperate with respective recesses 22 and 23 formed in the brake pedal plate 16 so as to afford the detachable connection between the pedal pad assembly 17 and the plate 16. The tabs 19 are generally "L" shaped in cross-section and are more rigid than the upper tab 21. The flexibility of the tab 21 and its inclined outer surface permits it to be conveniently snap fitted on to the pedal pad plate 16. The broken line view of FIG. 4 illustrates the deflection of tab 21 which occurs during this assembly. The backing piece 18 and tabs 19 and 21 may be conveniently formed from a molded plastic of any suitable type.

The rearwardmost surface of the backing piece 18 is normally spaced from the forwardmost surface of the pedal pad plate 16 by a distance indicated by the dimension D in FIG. 4. A plurality of compression springs 24 are received at one of their ends in pockets 25 formed in the backing piece 18 and bear against the pedal plate 16 to normally maintain the distance D. Alignment pins 26 also extend integrally from the rear of the backing piece 18 through enlarged apertures 27 formed in the pedal plate 16 so as to maintain alignment between the pedal assembly 17 and the plate 16 while permitting a certain degree of cocking movement between the pedal assembly 17 and the plate 16 for a reason to be described.

The backing piece 18 is affixed by either molding or by an adhesive to a rubber pad 28 which has a ribbed surface 29 that is adapted to be contacted by the foot of the vehicle operator. A metallic trim piece 31 is affixed to the rubber piece 28 in any known manner, as by means of folded over tabs 32.

Figure 7:
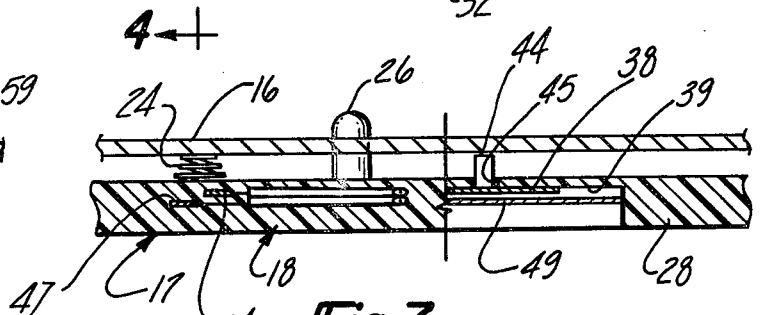
FIG. 7 is a cross-sectional view taken along the line 7—7 of FIG. 3.

A switch assembly, indicated generally by the reference numeral 33, is carried by the backing piece 18. The switch assembly 33 includes a first generally "T" shaped member that has a short leg 34 which forms a terminal for the switch and which is suitably affixed to the backing piece 18 and may be molded into it. A lead 37 is in electrical connection with the leg 34. A horizontally extending leg 38 extends from the leg 34 and is received within a complementary recess 39 formed in the forwardmost face of the backing piece 18 and which recess is enclosed by the rubber pad 28. A pair of actuating elements 44 are affixed to the opposite ends of the leg 38 and extend rearwardly through cylindrical apertures 45 formed in the backing piece 18. To reduce wear, minimize noise and provide electrical insulation, the actuating pins 44 are formed from a non-metallic material such as a plastic. The actuating pins 44 terminate closely adjacent the forwardmost surface of the pedal plate 16 when pressure is not applied to the pedal pad 17. The degree of clearance, which is best shown in FIGS. 4 and 7, determines the amount of movement of the pedal pad assembly 17 relative to the plate 16 before the switch 33 will be closed, as will become apparent.

The switch 33 includes a seond "T" shaped contact element having a short leg 47 that is affixed as by molding to the backing piece 18 and which is adapted to be in electrical contact with a second conductor 48 that extends through the backing piece 18. This second contact element includes a long horizontal leg 49 that extends through the recess 39 of the piece 18 and is normally spaced from the leg 38. Thus, the legs 38 and 39 are normally spaced from each other and the terminals of the conductors 37 and 48 provide an open circuit.

Figure 6:
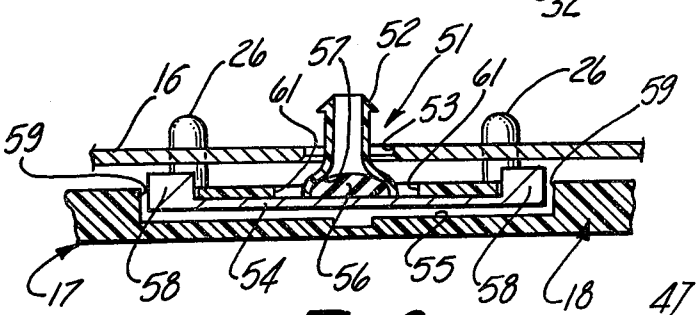
FIG. 6 is a cross-sectional view taken along the line 6—6 of FIG. 3.

When an operator does not apply pressure to the surfce 29 of the pedal pad 17, the distance D is maintained by the springs 24. The actuating pins 44 are, in this condition, spaced very slightly from the face of the brake pedal plate 16. This condition is shown in FIGS. 4, 6 and 7. When pressure is applied by the operator to the brake pedal pad 17 so as to apply the vehicle brakes, the springs 24 will initially yield so as to permit the pad assembly 17 to move slightly relative to the plate 16 to the position shown in FIG. 5. This movement is very slight and has been exaggerated in the drawings so as to make the operation of the device more readily understood. As the pad assembly 17 begins its rearward movement relative to the plate 16, the actuating pins 44 will engage the face of the plate 16 and cause the ends of the contact element leg 38 to deflect into engagement with the contact leg 49. A circuit is then complete between these two contact elements which may be employed to actuate the brake light either directly or through an appropriate relay. If a relay is to be employed, the relay may be embedded into the rubber material 28 of the pad assembly 17.

When the leg 38 deflects into engagement with the leg 49, this latter leg may also be deflected through the recess 39 so as to minimize the stresses on the contact elements. The force necessary to actuate the switch 33 depends primarily upon the strength of the springs 24. The rigidity of the leg 38 of the contact element will also enter into this determination. However, the springs 24 are more rigid than the contact element 38 so that they will primarily determine the force necessary to actuate the switch 33.

The connection between the pad 17 and the plate 16 is such that the pad 17 may pivot slightly relative to the plate 16. As has been previously noted, the pins 26 and plate apertures 27 limit the amount of pivotal movement. This pivotal movement is provided so as to insure that the switch 33 will be actuated even if the force applied to the pad 17 by the operator is other than in its center.

In addition to actuating the brake lights, the switch 33 may be used to electrically deactivate a speed control unit of the automobile and also to deactivate a lock up clutch of the automatic transmission. Alternatively, if it is desired to provide separate switches for each of these functions, additional switch assemblies like the switch assembly 33 may be molded into the brake pad 17 for each function. If such separate switches are used, the actuating pin 44 associated with each switch may be made of a different length to provide the desired sequence of actuation. For example, it may be desirable to deactivate either or both of the speed control or lock up clutch prior to illumination of the brake lights. This may be done by providing actuating pins for these switch elements that are longer than the pin 44 associated with the brake light switch.

To provide additional safety back up for deactivating the speed control unit, a vacuum interrupter device, indicated generally by the reference numeral 51, is also provided in the pedal pad 17. The vacuum interrupter device 51 includes a nipple 52 that is either molded integrally with the backing piece 18 or which may be separately affixed to it. The nipple 52 extends with clearance through an opening 53 in the pedal plate 16 and has an flexible conduit 50 connected to it. The conduit 50 is in pneumatic circuit in any suitable manner with the vacuum servo motor (not shown) of the speed control device. As is well known, a vacuum servo motor is used for holding the accelerator linkage in the appropriate position to maintain the preset vehicle speed.

A contact bar 54 is mounted within a recess 55 formed in the backing piece 18 and carries a valving element 56 that cooperates with a seat 57 formed in the base of the nipple 52. The contact bar 54 has a pair of rearwardly extending projections 58 that extend through apertures 59 in the backing piece 18 and which are juxtaposed to forward face of the pedal plate 16. When the springs 24 hold the pedal pad 17 at the distance D from the pedal plate 16, the valving element 56 will be drawn into engagement with the seat 57 so as to close off any atmospheric bleed to the vacuum servo motor of the speed control device. When the brake pedal pad 17 is engaged by an operator's foot and the springs 24 yield, the projections 58 will engage the pedal plate 16 and force the valving element 56 away from the seat 57. An atmospheric leak will, therefore, be created which may be augmented through an opening 61 formed in the backing piece 18 in proximity to the nipple 52. This atmospheric leak will cause deactivation of the speed control unit even if the electrical deactivation has been inoperative.

As with the switch 33, the vacuum interrupting device 51 will also operate if the pedal pad 17 pivots relative to the pedal plate 16 due to the unequal application of operator pressure to it.

If desired, the rubber pad 28 may be provided with an integral rearwardly extending flange around its outer periphery that will encircle the pedal plate 16 so as to conceal it. Such a flange is not shown but it is believed that its construction should be obvious to those skilled in the art. The use of such a flange would not interfere with the relative movement between the pad 17 and the pedal plate 16 but serves primarily an appearance function.

It should be readily apparent that pedal operated signal device illustrated and described provides an early indication of brake application and which can also be used to deactivate various other systems such as speed control and transmission lock ups. The device can be conveniently changed so as to set the pressure necessary to activate it and can be pre-adjusted by the manufacturer of the pedal pad assembly so that no adjustments will be required upon installation. The sealed configuration also protects the components against wear and the entrainment of foreign particles that would adversely effect its life. Various changes and modifications may be made without departing from the spirit and scope of the invention, as defined by the appended claims.

I claim:

1. A signal mechanism for a pedal operated device comprising an actuating element for said device, a pedal pad detachably connected to said actuating element for limited relative movement thereto, first and second flexible electrical contacts supported by said pedal pad for movement relative to each other, means including a pair of elements associated with one of said electrical contacts and engageable with said actuating element for effecting relative movement of said contacts into engagement to complete an electrical circuit upon movement of said pedal pad relative to said actuating element.

2. A signal mechanism as set forth in claim 1 wherein the pedal pad comprises a relatively rigid backing piece and an attached pad portion, the electrical contacts being supported by said backing piece and configured in a recess defined by said backing piece and said pad portion.

3. A signal mechanism as set forth in claim 2 wherein the electrical contacts comprise "T" shaped elements having their long legs juxtaposed to each other, the means for moving the one contact comprising a pair of actuating pins affixed to the ends of the long leg of said one "T" shaped element and extending through apertures in the backing piece for engagement with the actuating element.

4. A signal mechanism as set forth in claims 2 or 3 wherein the backing piece is with integral tabs for effecting a detachable connection to the actuating element.

5. A signal mechanism as set forth in claim 4 wherein the backing piece carries spring means adapted to engage the actuating element for holding the pedal pad in a spaced position from the actuating element, said spring means being effective to yield upon the application of pressure to said pedal pad for actuating the electrical contacts.

6. A pedal pad adapted to be detachably affixed to a pedal and operative to provide a signal, said pedal pad comprising a rigid backing piece having tab means thereon adapted to cooperate with the associated pedal for detachably connecting said backing piece to the pedal, a pad affixed to said backing piece and having a surface adapted to be engaged by the foot of an operator, first and second electrical contacts affixed to said backing piece and having spaced, cantilevered portions, said electrical contacts being normally spaced for each other, said backing piece and said pad defining a recess in which said contacts are received, and an insulating actuating pin affixed to one cantilevered end of one of said contacts and extending through an aperture in said backing piece for engagement with the associated pedal for closing an electrical circuit upon movement of said pedal pad relative to the associated pedal.

7. A pedal pad as set forth in claim 6 wherein the backing piece further includes a pair of spaced projections adapted to extend through respective apertures in the associated pedal for confining the pivotal movement of said pedal pad relative to the associated pedal.

8. A pedal pad as set forth in claim 6 wherein the backing pice is formed with a plurality of recesses on the side adjacent the pedal and further including spring means supported within said recesses and adapted to engage the associated pedal for maintaining a predetermined normal spacing therebetween.

* * * * *